US008843027B2

(12) United States Patent
Mori et al.

(10) Patent No.: US 8,843,027 B2
(45) Date of Patent: Sep. 23, 2014

(54) PHOTOSENSITIVE CARTRIDGE

(75) Inventors: Hiroki Mori, Nagoya (JP); Yasumasa Fujii, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 198 days.

(21) Appl. No.: 13/361,593

(22) Filed: Jan. 30, 2012

(65) Prior Publication Data

US 2012/0195630 A1 Aug. 2, 2012

(30) Foreign Application Priority Data

Jan. 31, 2011 (JP) ..... 2011-018642

(51) Int. Cl.
*G03G 21/18* (2006.01)
*G03G 15/02* (2006.01)

(52) U.S. Cl.
CPC ..... *G03G 21/1814* (2013.01); *G03G 15/0258* (2013.01)
USPC ..... 399/115

(58) Field of Classification Search
USPC ..... 399/111, 115, 170, 173
See application file for complete search history.

(56) References Cited

U.S. PATENT DOCUMENTS

| | | | | |
|---|---|---|---|---|
| 5,060,016 | A | 10/1991 | Wanou et al. | |
| 5,465,136 | A | 11/1995 | Watanabe | |
| 5,742,874 | A * | 4/1998 | Koshimura et al. | 399/100 |
| 7,734,216 | B2 | 6/2010 | Itabashi et al. | |
| 7,809,306 | B2 * | 10/2010 | Itabashi | 399/100 |
| 8,369,734 | B2 | 2/2013 | Shimizu et al. | |
| 2006/0233568 | A1 | 10/2006 | Itabashi et al. | |
| 2010/0129111 | A1 * | 5/2010 | Tamura | 399/111 |
| 2010/0166456 | A1 | 7/2010 | Shimizu et al. | |

FOREIGN PATENT DOCUMENTS

| | | | |
|---|---|---|---|
| JP | 64-020579 | | 1/1989 |
| JP | 05-100548 | A | 4/1993 |
| JP | 06-273987 | | 9/1994 |
| JP | 10-187007 | A | 7/1998 |
| JP | 2000-204759 | A | 7/2000 |
| JP | 2006-098509 | | 4/2006 |
| JP | 2006-276222 | A | 10/2006 |
| JP | 2007-086664 | A | 4/2007 |
| JP | 2010-156757 | A | 7/2010 |

OTHER PUBLICATIONS

JP Office Action mail Mar. 5, 2013, JP Appln. 2011-018642, English translation.

* cited by examiner

*Primary Examiner* — Walter L Lindsay, Jr.
*Assistant Examiner* — Rodney Bonnette
(74) *Attorney, Agent, or Firm* — Banner & Witcoff, Ltd.

(57) ABSTRACT

A photosensitive cartridge includes: a photosensitive member mounted to the photosensitive cartridge such that a surface thereof is movable in a first direction; an electric discharge electrode that extends in a second direction at an interval with the surface of the photosensitive member, the second direction being orthogonal to the first direction and parallel with the surface of the photosensitive member; a frame holding the photosensitive member and the electric discharge electrode and including an opening at an opposite side of the photosensitive member across the electric discharge electrode, the opening extending in the second direction; a cleaner movable along the opening so as to clean the electric discharge electrode; and a reinforcement member, which is a separate member from the cleaner, and which is contactable with the frame to reinforce a surrounding part of the opening.

8 Claims, 10 Drawing Sheets

PHOTOSENSITIVE CARTRIDGE

CROSS-REFERENCE TO RELATED APPLICATIONS

This application claims priority from Japanese Patent Application No. 2011-018642 filed on Jan. 31, 2011, the entire subject matter of which is incorporated herein by reference.

TECHNICAL FIELD

The invention relates to a photosensitive cartridge that is mountable to an image forming apparatus.

BACKGROUND

In an image forming apparatus such as laser printer and the like, a process cartridge is removably mounted in a body of the image forming apparatus.

A frame of the process cartridge holds a photosensitive drum, a charger and a developing device. When forming an image, the photosensitive drum rotates at constant rotating speed. Accompanied by the rotation, a surface of the photosensitive drum is uniformly charged by the charger. Then, the uniformly charged part is selectively exposed, so that an electrostatic latent image is formed on the surface of the photosensitive drum. When the electrostatic latent image faces the developing device, toner is supplied to the electrostatic latent image from the developing device, so that the electrostatic latent image is developed as a toner image. The toner image is transferred to a sheet from the photosensitive drum. Thereby, an image is formed on the sheet.

The charger includes: an electrical discharge wire that extends in a direction parallel with a rotational axis line of the photosensitive drum; and a grid electrode that is interposed between the photosensitive drum and the electrical discharge wire, for example. A high voltage is applied to the electrical discharge wire, so that a corona discharge is generated from the electrical discharge wire. When an appropriate voltage is applied to the grid electrode, an amount of charges (i.e., ions) reaching the surface of the photosensitive drum is controlled to be constant.

A part of the frame facing the electrical discharge wire is formed with a rectangular opening corresponding to the electrical discharge wire. Thereby, it is possible to introduce air flow into the frame through the opening from the outside of the frame. By the air flow, it is possible to prevent dusts and the like from being attached to the electrical discharge wire.

SUMMARY

In the above-described process cartridge, the frame has lower strength at a surrounding part of the opening. Thus, when transporting the process cartridge, for example, external force is applied to the frame, so that the frame may be deformed at the surrounding part of the opening. Also, the grid electrode is bending-deformed by the deformation of the frame, so that a problem such as contact of the grid electrode and the photosensitive drum may be caused.

Therefore, illustrative aspects of the invention provide a photosensitive cartridge capable of preventing a frame being deformed at a surrounding part of an opening thereof.

According to one illustrative aspect of the invention, there is provided a photosensitive cartridge comprising: a photosensitive member mounted to the photosensitive cartridge such that a surface of the photosensitive member is movable in a first direction; an electric discharge electrode that extends in a second direction at an interval with the surface of the photosensitive member, wherein the second direction is orthogonal to the first direction and is parallel with the surface of the photosensitive member; a frame, which holds the photosensitive member and the electric discharge electrode, and which comprises an opening at an opposite side of the photosensitive member across the electric discharge electrode, wherein the opening extends in the second direction; a cleaner configured to be movable along the opening so as to clean the electric discharge electrode; and a reinforcement member, which is a separate member from the cleaner, and which is configured to contact the frame to reinforce a surrounding part of the opening.

According to the invention, the photosensitive member is mounted such that a surface thereof can move in the first direction. The electrical discharge electrode extends in the second direction that is orthogonal to the first direction and parallel with the surface of the photosensitive member at an interval with the surface of the photosensitive member. The photosensitive member and the electrical discharge electrode are held by the frame.

The opening is formed in the frame at an opposite side of the photosensitive member across the electrical discharge electrode. Thereby, it is possible to introduce air flow into the frame through the opening from the outside of the frame. By the air flow, it is possible to prevent dusts and the like from being attached to the electrical discharge electrode. Also, it is possible to remove the dusts and the like attached to the electrical discharge electrode. As a result, it is possible to generate the uniform electrical discharge from the electrical discharge electrode in the second direction.

Also, the cleaner is mounted to be movable along the opening. When the cleaner is moved along the opening, the electrical discharge electrode is cleaned by the cleaner, so that the dusts and the like attached to the electrical discharge electrode are removed. Accordingly, the electrical discharge electrode is cleaned, so that it is possible to generate the more uniform electrical discharge from the electrical discharge electrode in the second direction A reinforcement member, which is a separate member from the cleaner, contacts the frame. Since the surrounding part of the opening of the frame is reinforced by the reinforcement member, it is possible to prevent the frame being deformed at the surrounding part of the opening thereof. Therefore, according to the configuration in which the grid electrode is provided between the electrical discharge electrode and the photosensitive member, it is possible to prevent the deformation of the grid electrode and the contact of the grid electrode and the photosensitive member.

DETAILED DESCRIPTION

Exemplary embodiments of the invention will now be described with reference to the drawings.

1. Image Forming Apparatus

Figure 1:
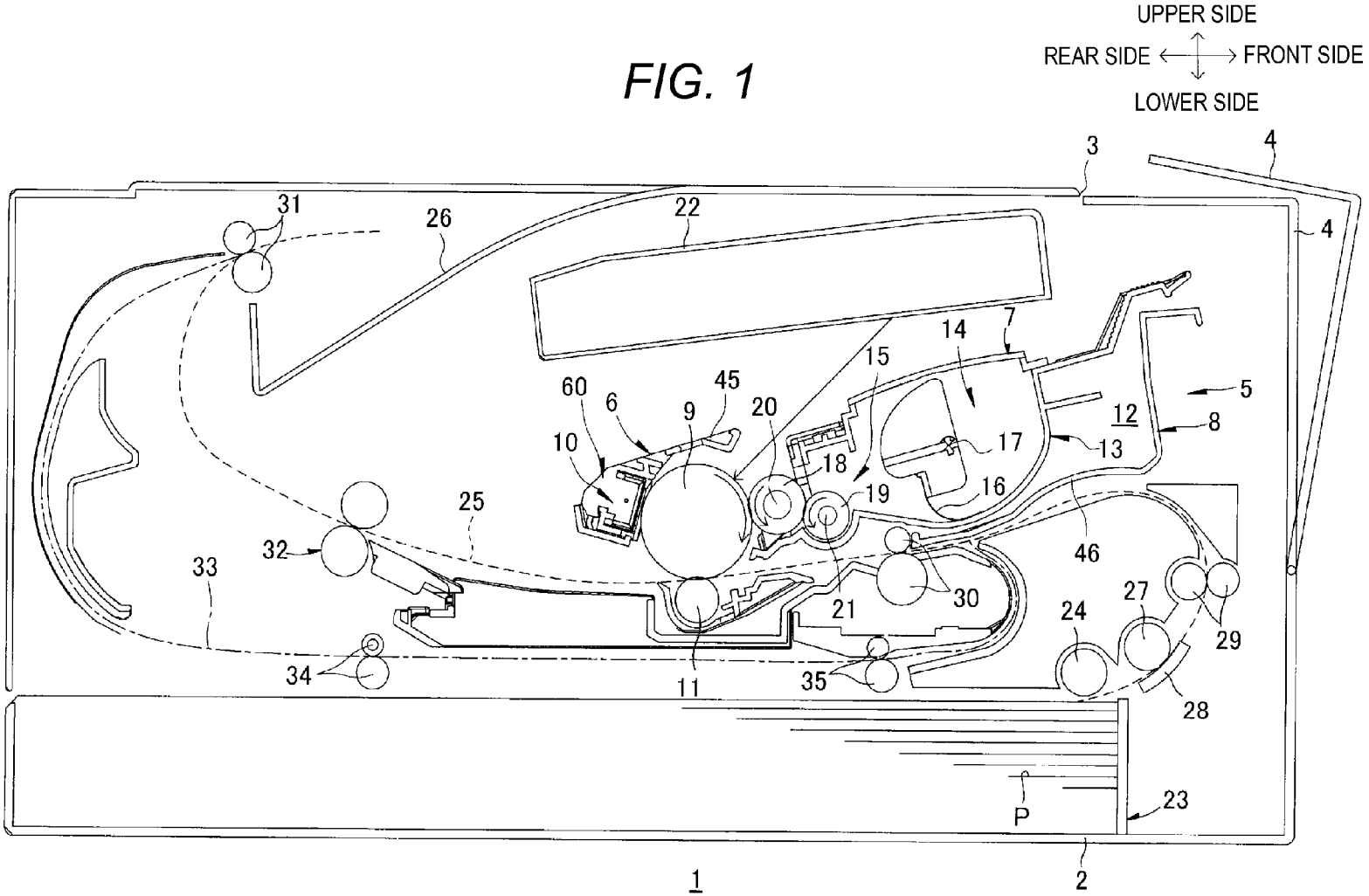
FIG. 1 is a sectional view of an image forming apparatus having a drum cartridge according to an exemplary embodiment of the invention.

As shown in FIG. 1, an image forming apparatus 1 includes a body casing 2. A cartridge mounting/removing opening 3 and a front cover 4 that opens and closes the cartridge mounting/removing opening 3 are formed in a sidewall of a front face side of the body casing 2. Incidentally, a laser printer is one example of the image forming apparatus 1.

Incidentally, the front face side of the image forming apparatus 1 is a front side of a front-rear direction. Also, at a state in which the image forming apparatus 1 is put on a plane, a direction orthogonal to the plane is an upper-lower direction. The left and the right of the image forming apparatus 1 are defined when seeing the image forming apparatus 1 put on the plane from the front side.

A process cartridge 5 is mounted at a slightly more forward side than the center in the body casing 2. At a state in which the front cover 4 is opened, the process cartridge 5 is mounted into the body casing 2 and is detached from the body casing 2 through the cartridge mounting/removing opening 3.

The process cartridge 5 includes a drum cartridge 6 (one example of a photosensitive cartridge) and a developing cartridge 7 that is removably mounted to the drum cartridge 6.

The drum cartridge 6 includes a drum frame 8 (one example of a frame). A photosensitive drum 9 (one example of a photosensitive member) is rotatably held at a rear end portion of the drum frame 8. The drum frame 8 also holds a charger 10 and a transfer roller 11. The charger 10 and the transfer roller 11 are respectively arranged at the rear side of the photosensitive drum 9 and below the photosensitive drum 9.

A part of the drum frame 8, which is located at a more forward position than the photosensitive drum 9, configures a cartridge mounting part 12. The developing cartridge 7 is mounted to the cartridge mounting part 12.

The developing cartridge 7 includes a housing 13 for accommodating toner. A hopper 14 and a developing chamber 15 communicating with each other are formed in the housing 13 so that they are adjacent to each other in the front-rear direction.

The hopper 14 is a space for accommodating the toner. An agitator 16 made of a resin film is accommodated in the hopper 14. The agitator 16 is adhered to an agitator shaft 17 extending in the left-right direction and is mounted to be integrally rotatable with the agitator shaft 17. As the agitator 16 is rotated, the toner accommodated in the hopper 14 is stirred and supplied to the developing chamber 15 from the hopper 14.

The developing chamber 15 includes a developing roller 18 and a supply roller 19 such that the developing roller 18 and the supply roller 19 are rotatable about a developing roller shaft 20 and a supply roller shaft 21, respectively. The developing roller shaft 20 and the supply roller shaft 21 extend in the left-right direction. The developing roller 18 is arranged such that a part of a surface (peripheral surface) thereof is exposed from a rear end portion of the housing 13. The developing cartridge 7 is mounted to the drum cartridge 6 such that the surface of the developing roller 18 contacts a surface (peripheral surface) of the photosensitive drum 9. The supply roller 19 is arranged such that a surface (peripheral surface) thereof contacts the surface of the developing roller 18 from a front-lower side. The toner in the developing chamber 15 is supplied to the surface of the developing roller 18 by the supply roller 19, so that the toner is carried on the surface of the developing roller 18 as a thin layer.

In the body casing 2, an exposing device 22 having a laser and the like is arranged above the process cartridge 5.

When forming an image, the photosensitive drum 9 is rotated at constant speed in a clockwise direction, when seen from the left side. As the photosensitive drum 9 is rotated, the surface of the photosensitive drum 9 is uniformly charged by electrical discharge from the charger 10. In the meantime, a laser beam is emitted from the exposing device 22, based on image data received from a personal computer (not shown) connected to the image forming apparatus 1. The laser beam passes between the charger 10 and the developing cartridge 7 and is then illuminated to the surface of the photosensitive drum 9 uniformly charged, thereby selectively exposing the surface of the photosensitive drum 9. Accordingly, charges are selectively removed from the exposed part of the photosensitive drum 9, so that an electrostatic latent image is formed on the surface of the photosensitive drum 9. When the electrostatic latent image faces the developing roller 18 as the photosensitive drum 9 is rotated, the toner is supplied to the electrostatic latent image from the developing roller 18. Therefore, a toner image is formed on the surface of the photosensitive drum 9.

A sheet feeding tray 23 that accommodates sheet P is arranged at a bottom part of the body casing 2. A pickup roller 24 for sending the sheet from the sheet feeding tray 23 is provided above the sheet feeding tray 23.

A conveyance path 25 having an S shape, when seen from a side, is formed in the body casing 2. The conveyance path 25 extends from the sheet feeding tray 23 to a sheet discharge tray 26, which is formed on the upper surface of the body casing 2, via a space between the photosensitive drum 9 and the transfer roller 11. A separation roller 27 and a separation pad 28, which are arranged to face each other, a pair of feeding rollers 29, a pair of registration rollers 30 and a pair of sheet discharge rollers 31 are provided in corresponding order on the conveyance path 25 in the conveyance direction of the sheet P.

The sheet P sent from the sheet feeding tray 23 passes between the separation roller 27 and the separation pad 28. At this time, the sheet is separated one at a time. After that, the sheet P is conveyed toward the registration rollers 30 by the feeding rollers 29. Then, the sheet P is conveyed toward between the photosensitive drum 9 and the transfer roller 11 at an appropriate timing by the registration rollers 30.

The toner image on the peripheral surface of the photosensitive drum 9 is electrically attracted and transferred to the sheet P by the transfer roller 11 when the toner image faces the sheet being passing between the photosensitive drum 9 and the transfer roller 11 as the photosensitive drum 9 is rotated.

On the conveyance path 25, a fixing device 32 is provided at a downstream side in the conveyance direction of the sheet P from the transfer roller 11. The sheet P having the toner image transferred thereon is conveyed through the conveyance path 25 and passes through the fixing device 32. In the fixing device 32, the toner image becomes an image and is thus fixed on the sheet P by heating and pressing.

The image forming apparatus 1 has, as operation modes, a one-sided mode and a double-sided mode. In the one-sided mode, an image (toner image) is formed on one surface of the sheet P. In the double-sided mode, after the image is formed on a first surface of the sheet P, an image is formed on a second surface, which is opposite to the first surface, of the sheet P.

In the one-sided mode, the sheet P having an image formed on one surface thereof is discharged onto the sheet discharge tray 26 by sheet discharge rollers 31.

As a configuration for realizing the double-sided mode, a reversal conveyance path 33 is formed in the body casing 2. The reversal conveyance path 33 extends between the conveyance path 25 and the sheet feeding tray 23 from a vicinity of the sheet discharge rollers 31 and is connected between the feeding rollers 29 and the registration rollers 30 on the conveyance path 25. A pair of first reversal conveyance rollers 34 and a pair of second reversal conveyance rollers 35 are provided on the reversal conveyance path 33.

In the double-sided mode, after an image is formed on a first surface of the sheet P, the sheet P is sent to the reversal conveyance path 33 by the sheet discharge rollers 31 without being discharged onto the sheet discharge tray 26. Then, the sheet P is conveyed through the reversal conveyance path 33 by the first reversal conveyance rollers 34 and the second reversal conveyance rollers 35 so that the face of the sheet P is reversed. Then, the reversed sheet P is sent to the conveyance path 25 in a state in which a second surface, on which an image is not formed, faces the peripheral surface of the photosensitive drum 9. Then, an image is formed on the second surface of the sheet P, so that the images are formed on both surfaces of the sheet P. The sheet P having the images formed on both surfaces is discharged onto the sheet discharge tray 26 by the sheet discharge rollers 31.

2. Drum Cartridge (1) Drum Frame

Figure 2:
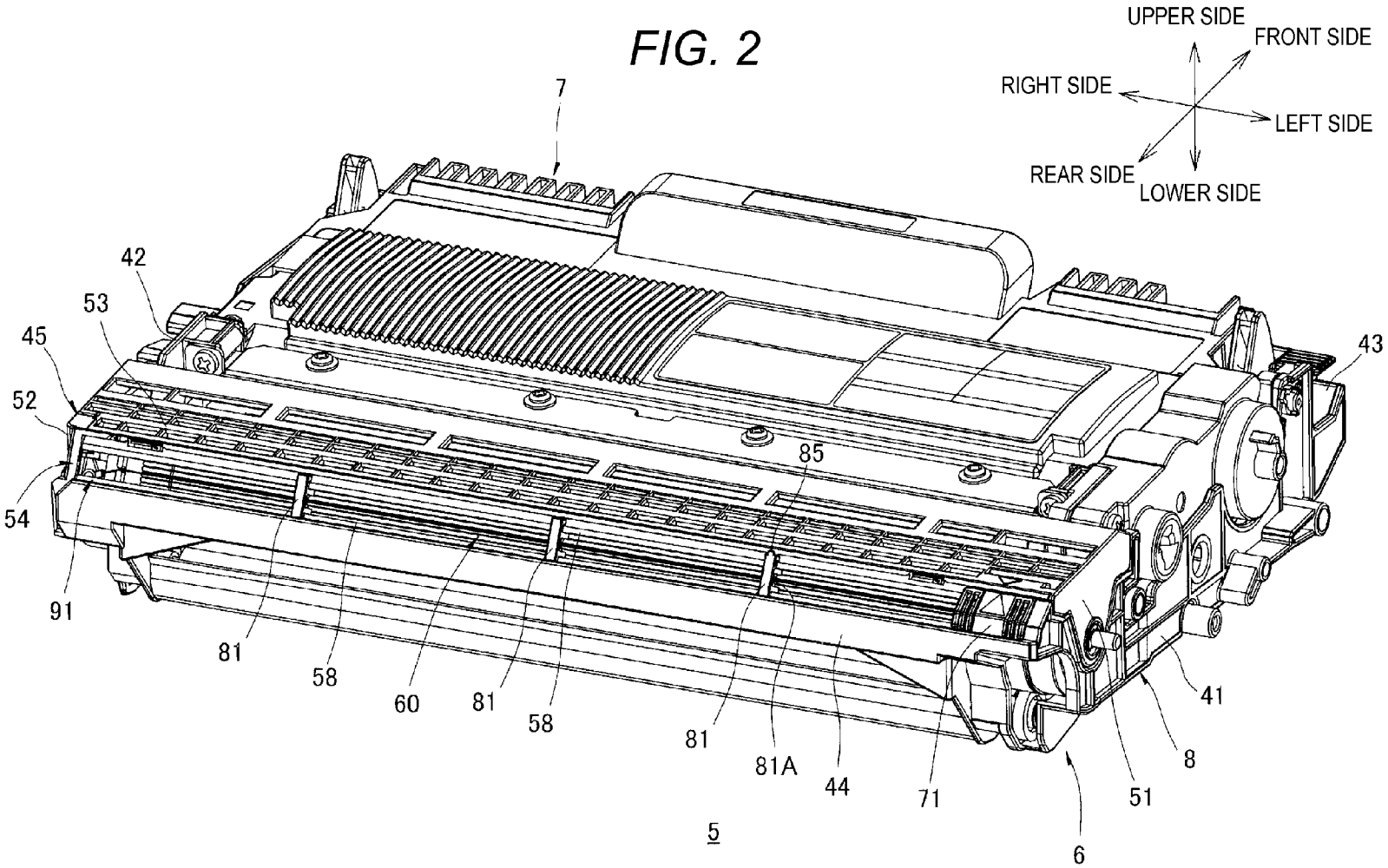
FIG. 2 is a perspective view of a process cartridge shown in FIG. 1.

The drum frame 8 of the drum cartridge 6 is made of resin. As shown in FIG. 2, the drum frame 8 has a left sidewall 41 and a right sidewall 42. The left sidewall 41 and the right sidewall 42 have a plate shape extending in the front-rear direction and are opposed to each other at an interval in the left-right direction.

A front sidewall 43 extends between respective front end portions of the left sidewall 41 and the right sidewall 42.

Figure 3:
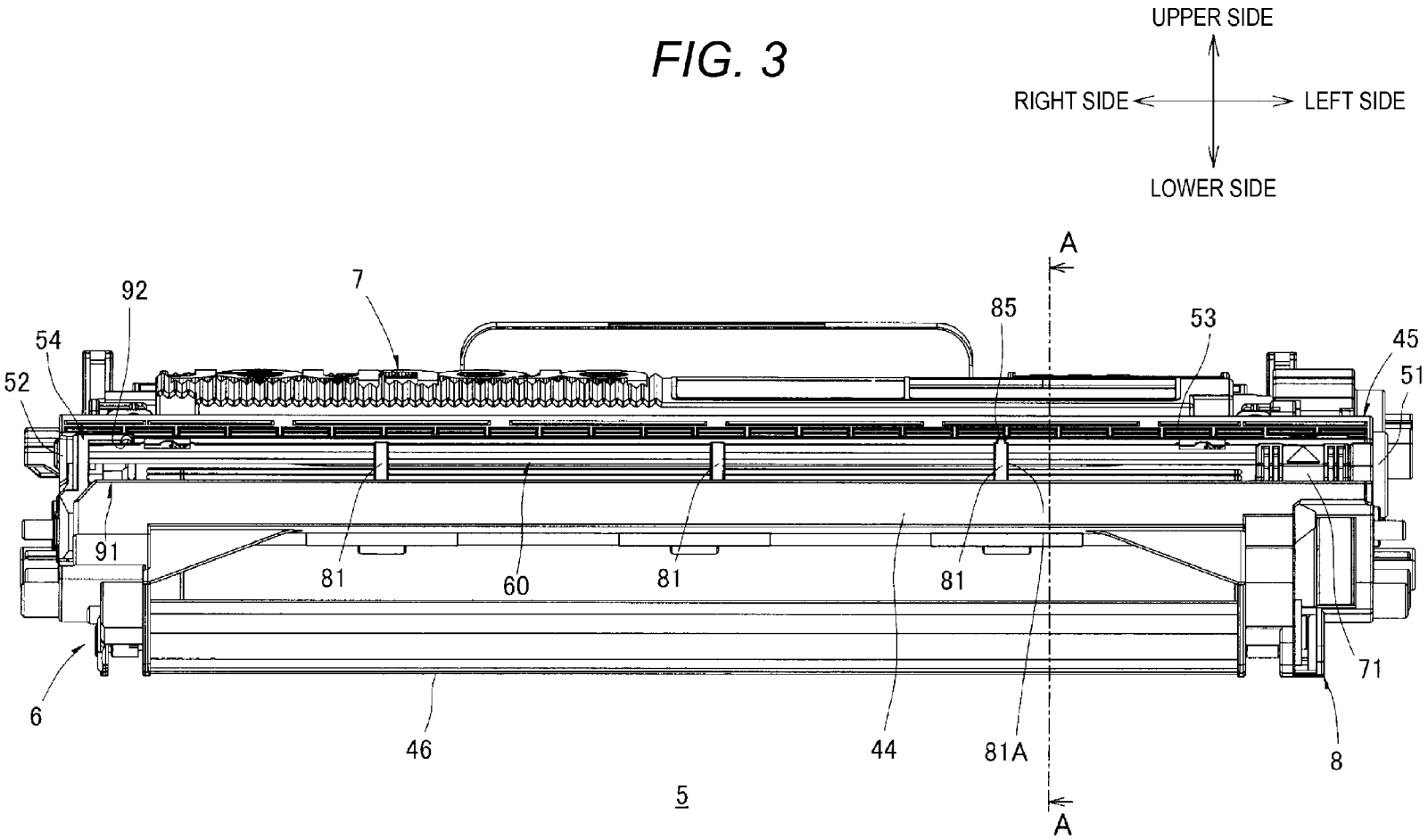
FIG. 3 is a rear view (view seen from the rear side) of the process cartridge.

As shown in FIG. 3, a rear sidewall 44 extends between respective rear end portions of the left sidewall 41 and the right sidewall 42.

As shown in FIGS. 2 and 3, an upper wall 45 extends between the respective rear end portions of the left sidewall 41 and the right sidewall 42 such that the upper wall 45 covers the respective rear end portions of the left sidewall 41 and the right sidewall 42 from the upper side.

Figure 4:
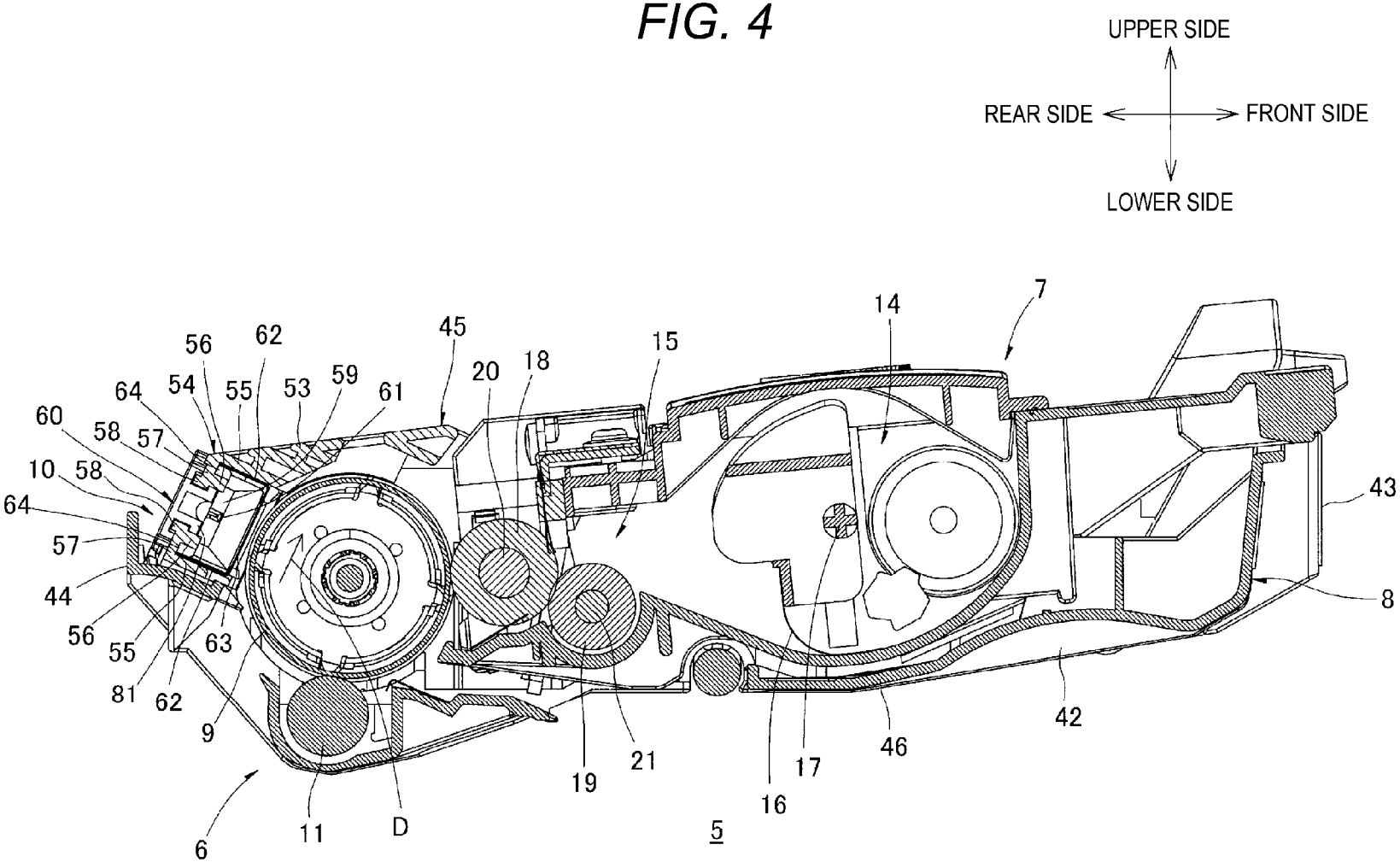
FIG. 4 is a sectional view of the process cartridge taken along a line A-A of FIG. 3.

As shown in FIG. 4, a lower wall 46 extends between respective lower end portions of the left sidewall 41 and the right sidewall 42.

The photosensitive drum 9 and the transfer roller 11 are rotatably supported by the left sidewall 41 and the right sidewall 42 in a space between the upper wall 45 and the lower wall 46.

The charger 10 is held at the upper wall 45.

A part of a space between the left sidewall 41 and the right sidewall 42, which part is not opposed to the upper wall 45 and has an opened upper side, configures the cartridge mounting part 12 (refer to FIG. 1).

(2) Upper Wall

As shown in FIGS. 2 and 3, the upper wall 45 integrally includes a pair of left opposing part 51 and right opposing part 52, a covering part 53 and a charger holder 54.

As shown in FIG. 2, the left opposing part 51 and the right opposing part 52 have the same triangular shape convex downwards in a side view. The left opposing part 51 and the right opposing part 52 are opposed to each other from outer sides of the respective rear-upper end portions of the left sidewall 41 and the right sidewall 42 in the left-right direction.

The covering part 53 extends between upper ends of the left opposing part 51 and the right opposing part 52. The covering part 53 has a lattice shape. The covering part 53 is formed to cover the photosensitive drum 9 from the upper side at an interval above the photosensitive drum 9 (refer to FIG. 1).

The charger holder 54 is provided at the rear side of the covering part 53. As shown in FIG. 4, the charger holder 54 integrally includes a pair of outer support parts 55, inner support parts 56, connection parts 57 and engaging parts 58. The charger holder 54 includes a pair of wire support parts 59.

The pair of outer support parts 55 has a plate shape going up in the rear direction (going down in the front direction) and extending in the left-right direction and is arranged at an interval in a direction orthogonal to the extending direction of going up rearwards.

The inner support parts 56 are provided at inner sides of the pair of outer support parts 55 and are opposed to rear-upper end portions of the respective outer support parts 55 with slight intervals therebetween. The inner support parts 56 have a rectangular section parallel with the outer support parts 55.

The connection parts 57 are provided between the rear-upper end portions of the respective outer support parts 55 and rear-upper end portions of the inner support parts 56 opposed to the outer support parts 55.

The engaging parts 58 are continuously formed from the rear-upper end portions of the inner support parts 56. The engaging parts 58 have a rectangular section protruding from the inner support parts 56 in inner and rear-upper directions of the facing direction (hereinafter, abbreviated as 'facing direction') of the outer support parts 55. Thereby, steps are respectively formed between the engaging parts 58 and an inner surface and a rear-upper end surface of the facing direction of the inner support parts 56. As shown in FIG. 2, the one engaging part 58 and the other engaging part 58 are opened therebetween, as a rectangular opening 60 extending in the left-right direction.

The wire support parts 59 are opposed to each other at an interval that is larger than at least a width of the area of the surface of the photosensitive drum 9 in the left-right direction, on which area the electrostatic latent image is formed. The wire support parts 59 have a plate shape extending in a direction orthogonal to the left-right direction.

(3) Charger

As shown in FIG. 4, the charger 10 includes an electric discharge wire 61 (one example of an electric discharge electrode), a pair of shield electrodes 62 and a grid electrode 63.

The electric discharge wire 61 is provided between the wire support parts 59. The electric discharge wire 61 extends, at an interval with the surface of the photosensitive drum 9, in a second direction (i.e., left-right direction), which is parallel with the surface of the photosensitive drum 9 and is orthogonal to a first direction. Here, the first direction (i.e., direction indicated by an arrow D of FIG. 4) is a moving direction of a part of the surface of the photosensitive direction 9 opposed to the electric discharge wire 61. When a high voltage is applied to the electric discharge wire 61, a corona discharge is generated from the electric discharge wire 61.

The pair of shield electrodes 62 has a thin metal plate shape extending in the left-right direction, respectively. A rear-upper end portion of each shield electrode 62 includes a nipped part 64. The nipped parts 64 are inserted between the outer support parts 55 and the inner support parts 56 opposing thereto and are nipped by the outer support parts 55 and the inner support parts 56, so that the respective shield electrodes 62 are mounted to the charge holder 54. At this state, the pair of shield electrodes 62 is respectively arranged at an upstream side and a downstream side of the first direction, so that the pair of shield electrodes 62 extends in parallel with the electric discharge wire 61 at an interval with the electric discharge wire 61. According to the pair of shield electrodes 62, it is possible to prevent the electric discharge from the electric discharge wire 61 from being leaked to the upstream side and the downstream side of the first direction.

The grid electrode 63 is integrally formed with the shield electrodes 62 and is provided between front-lower ends of the shield electrodes 62. The grid electrode 63 is opposed to the surface of the photosensitive drum 9 at an interval. The grid electrode 63 has a thin metal plate shape extending in the first direction and in the left-right direction. The grid electrode 63 includes a plurality of openings extending in the left-right direction and having a predetermined width, which are formed at a slight constant interval in a direction orthogonal to the longitudinal direction. Thereby, the grid electrode 63 has elongated electrode parts between the respective openings, which electrode parts extending in the left-right direction (second direction). As an appropriate voltage is applied to the grid electrode 63, an amount of charges (ions) reaching the surface of the photosensitive drum 9 from the electric discharge wire 61 is controlled to be constant.

(4) Wire Cleaner

As shown in FIGS. 2 and 3, the drum cartridge 6 includes a cleaner 71 for cleaning the electric discharge wire 61. The cleaner 71 is movable along the opening 60. When the cleaner 71 is moved along the opening 60, the electric discharge wire 61 is friction-contacted by the cleaner, so that the dusts and the like attached to the electric discharge wire 61 are removed.

(5) Reinforcement Member

Figure 5:
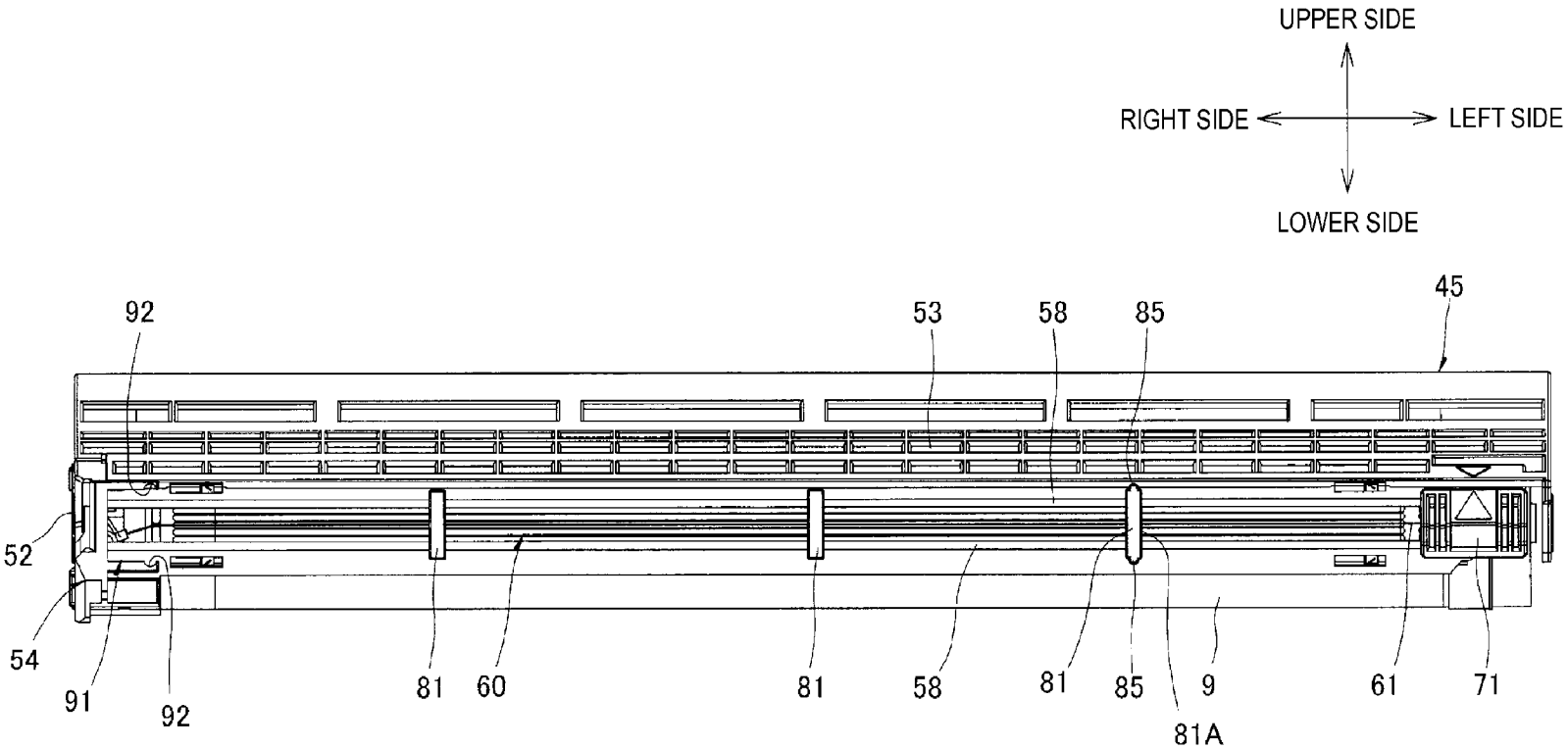
FIG. 5 is a rear view (view seen from the rear side) of a photosensitive drum and an upper wall shown in FIG. 4.

As shown in FIGS. 2 to 5, the drum cartridge 6 includes three reinforcement members 81. For a brand-new drum cartridge 6, the three reinforcement members 81 are arranged in the left-right direction having a distance therebetween and are provided to oppose to the opening 60, as shown in FIG. 5. For example, three reinforcement members 81 are arranged at an equal distance.

Figure 6:
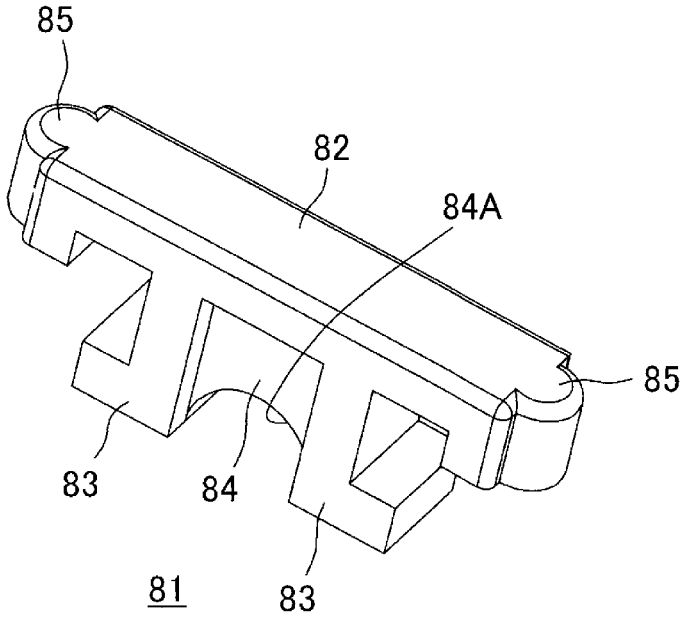
FIG. 6 is a perspective view of a leftmost reinforce member (rightmost reinforcement member shown in FIG. 2)

As shown in FIG. 6, the leftmost reinforcement member 81 (one example of a first reinforcement member), which is closest to the cleaner 71 among the reinforcement members 81 in the left-right direction, integrally includes an operation part 82, a pair of contact parts 83 and a beam part 84.

The operation part 82 has a substantially rectangular elongated plate shape. Both end portions of the operation part 82 in the longitudinal direction are bent into one side. Both end surfaces of the operation part 82 in the longitudinal direction are formed with cylindrical engaging protrusions 85 extending in the bending direction of both end portions of the longitudinal direction of the operation part 82.

The pair of contact parts 83 is connected to one surface (surface facing the electric discharge wire 61) of the operation part 82. Also, the pair of contact parts 83 is provided at an interval in the longitudinal direction of the operation part 82 and is line-symmetric with respect to a vertical line passing to a center of the one surface of the operation part 82 in the longitudinal direction. Each contact part 83 extends perpendicularly to the one surface of the operation part 82. Each contact part 83 has an L shape bending and extending to an outer side of the operation part 82 in the longitudinal direction. Each contact part 83 has the same width of the operation part 82 in a direction orthogonal to the longitudinal direction of the operation part 82.

The beam part 84 has a plate shape that is connected to the one surface of the operation part 82. The beam part 84 is provided between the pair of contact parts 83. One surface (surface opposed to the electric discharge wire 61) 84A of the beam part 84 is a semicircular arc surface recessed toward the operation part 82.

Figure 7:
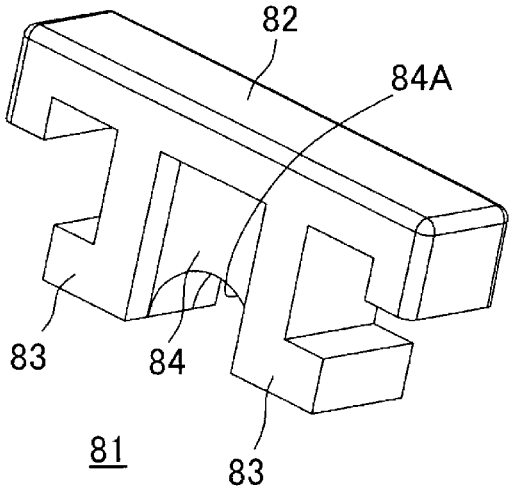
FIG. 7 is a perspective view of a central reinforcement member and a rightmost reinforce member (central and leftmost reinforcement members shown in FIG. 2)

As shown in FIG. 7, the center and rightmost reinforcement members 81 (one example of a second reinforcement member) have the same configuration as the leftmost reinforcement member 81 shown in FIG. 6, except that the engaging protrusions 85 are not formed in the operation part 82.

As shown in FIG. 4, leading end portions of the contact parts 83 are engaged with the steps between the engaging part 58 and the inner surfaces of the inner support parts 56 in the facing direction, and both end portions of the operation part 82 in the longitudinal direction are engaged with the steps between the engaging parts 58 and the rear-upper end surfaces of the inner support parts 56. Accordingly, the respective reinforcement members 81 are removably mounted to the drum frame 8 and are movable along the opening 60. At this state, the respective contact parts 83 contact the engaging parts 58 of the drum frame 8 from the inner side of the facing direction.

(6) Aside Part

The upper wall 45 of the drum frame 8 is provided at the right end portion of the opening 60 with a space enabling the three reinforcement members 81 to be arranged, as an aside part 91. A left end portion of the aside part 91 is formed with engaging recesses 92 that are recessed toward the outer side of the facing direction, in correspondence to the two engaging parts 85 of the leftmost reinforcement member 81.

(7) Cleaning Operation

For a brand-new drum cartridge 6, a right end portion of the cleaner 71 is arranged at a position (home position) approaching the left end portion of the opening 60, as shown in FIG. 5. As described above, the three reinforcement members 81 are arranged at an equal distance.

For example, when the toner in the housing 13 of the developing cartridge 7 becomes empty so that the developing cartridge 7 is replaced with a new product, it is necessary to clean the electric discharge wire 61 in order to prevent the non-uniformity of the electric discharge caused due to the contamination of the electric discharge wire 61. The cleaning is made by moving the cleaner 71 reciprocally in the left-right direction.

First, the cleaner 71 is moved rightwards. As the cleaner 71 is moved, the cleaner 71 slidingly contacts along the electric discharge wire 61. Thereby, the dusts and the like attached to the electric discharge wire 61 are scraped and dropped.

While the cleaner 71 is moved rightwards, the right end surface of the cleaner 71 contacts a left end surface 81A (one example of a contact surface) of the leftmost reinforcement member 81. After this contact, the cleaner 71 is moved rightwards, so that the leftmost reinforcement member 81 is pushed and thus moved rightwards by the cleaner 71.

Figure 8A:
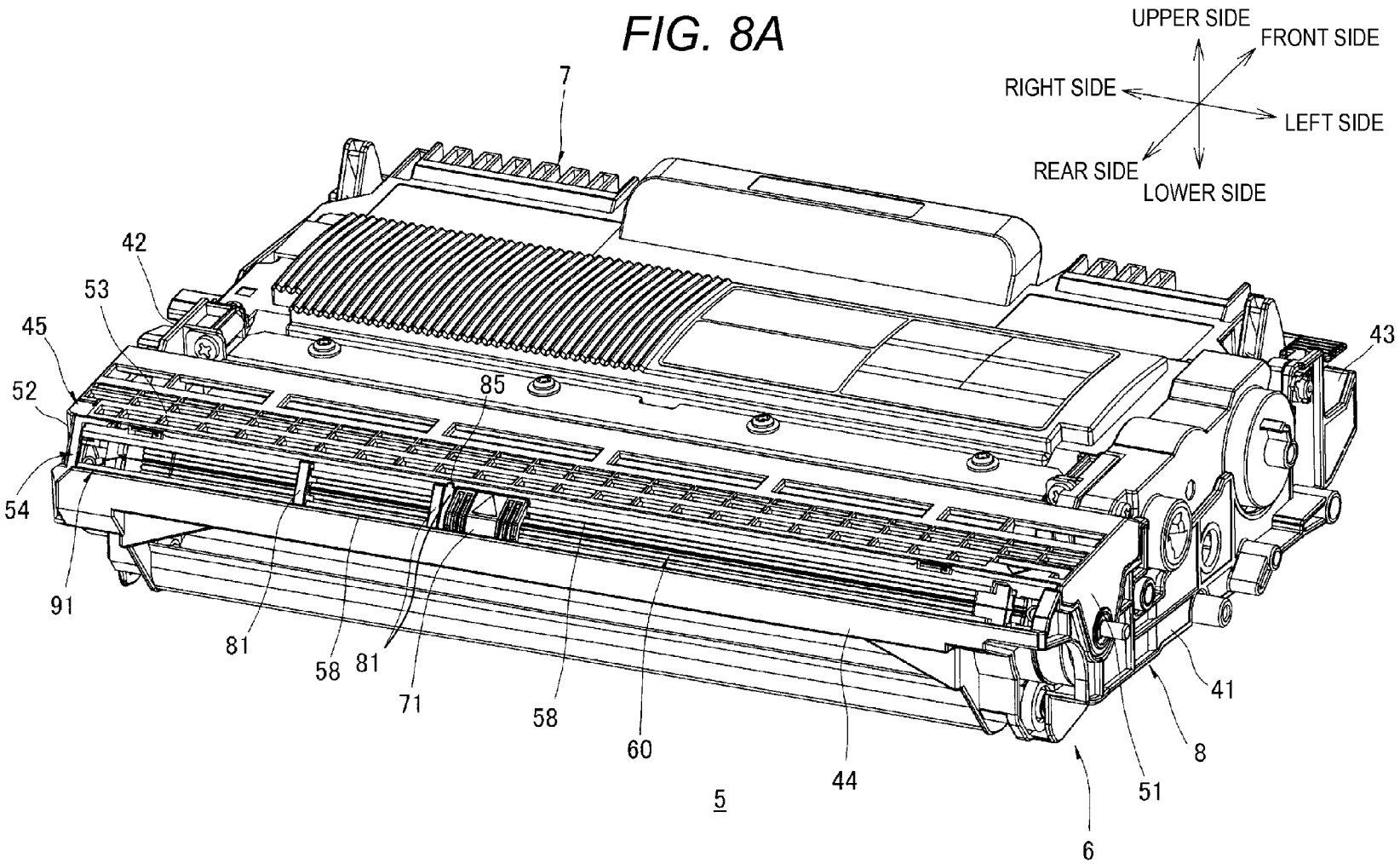
FIG. 8A is a perspective view of the process cartridge, which shows a cleaner that is being moved in a right direction (left direction in the drawing)
Figure 8B:
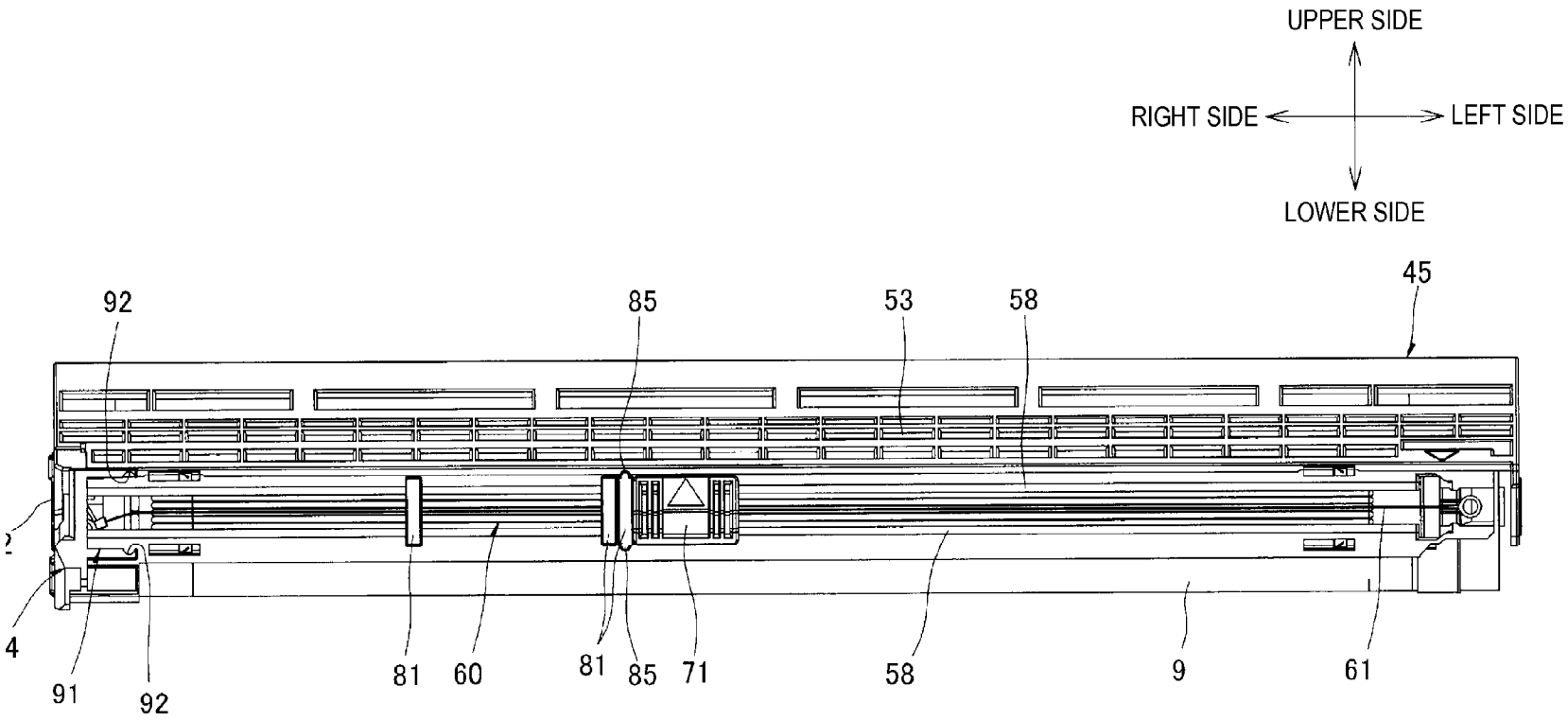
FIG. 8B is a rear view of the photosensitive drum and the upper wall, which shows the cleaner that is being moved in the right direction.

When the cleaner 71 and the leftmost reinforcement member 81 are further moved rightwards, the leftmost reinforcement member 81 contacts the central reinforcement member 81, as shown in FIGS. 8A and 8B. After this contact, the cleaner 71 is moved rightwards, so that the leftmost and central reinforcement members 81 are pushed and thus moved rightwards by the cleaner 71.

When the cleaner 71 is further moved rightwards, the central reinforcement member 81 pushed and moved rightwards by the cleaner 71 contacts the rightmost reinforcement member 81. After this contact, the cleaner 71 is moved rightwards, so that the three reinforcement members 81 are pushed and moved rightwards by the cleaner 71.

Figure 9A:
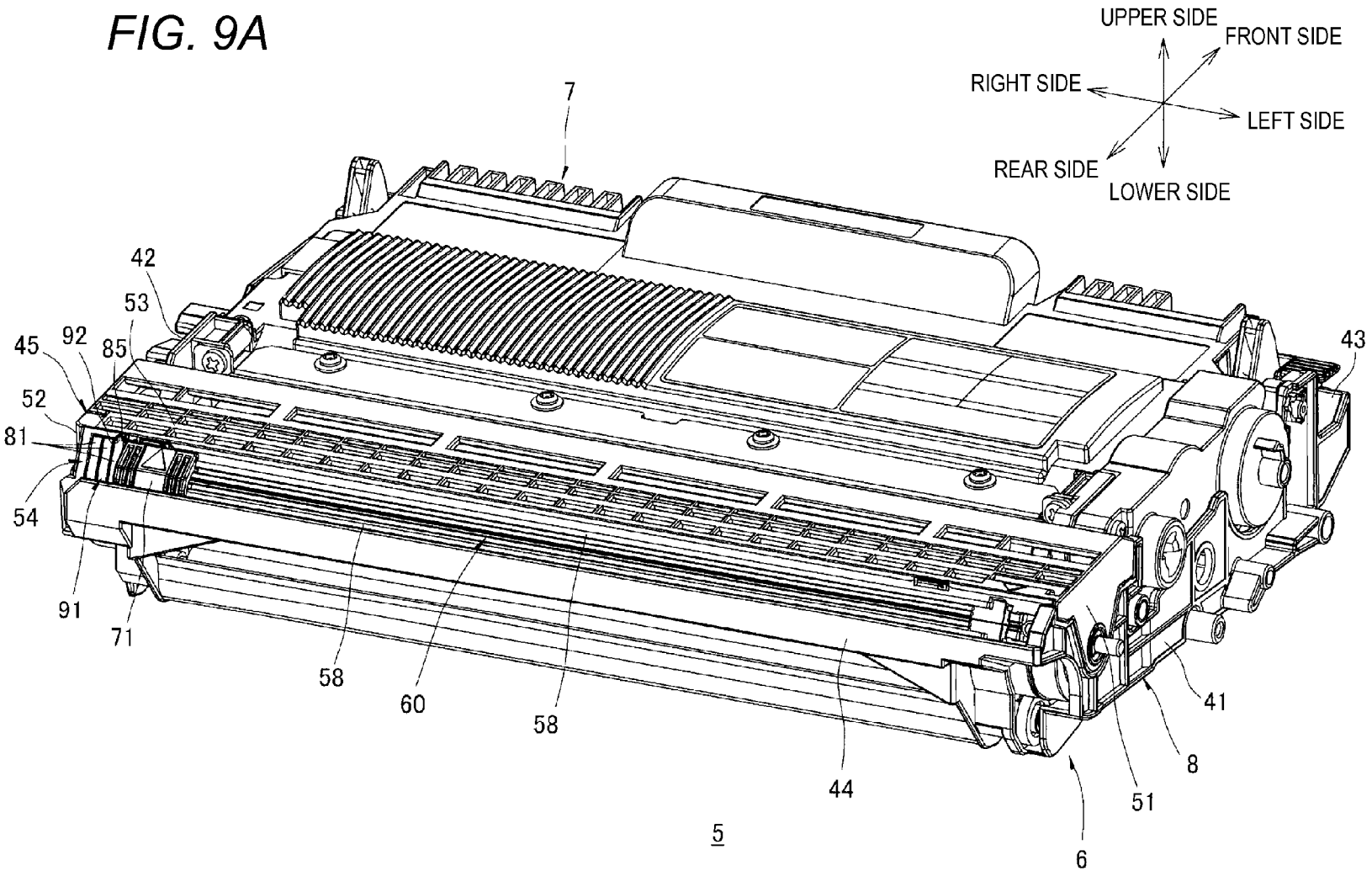
FIG. 9A is a perspective view of the process cartridge, which shows the cleaner that has completely moved in the right direction.
Figure 9B:
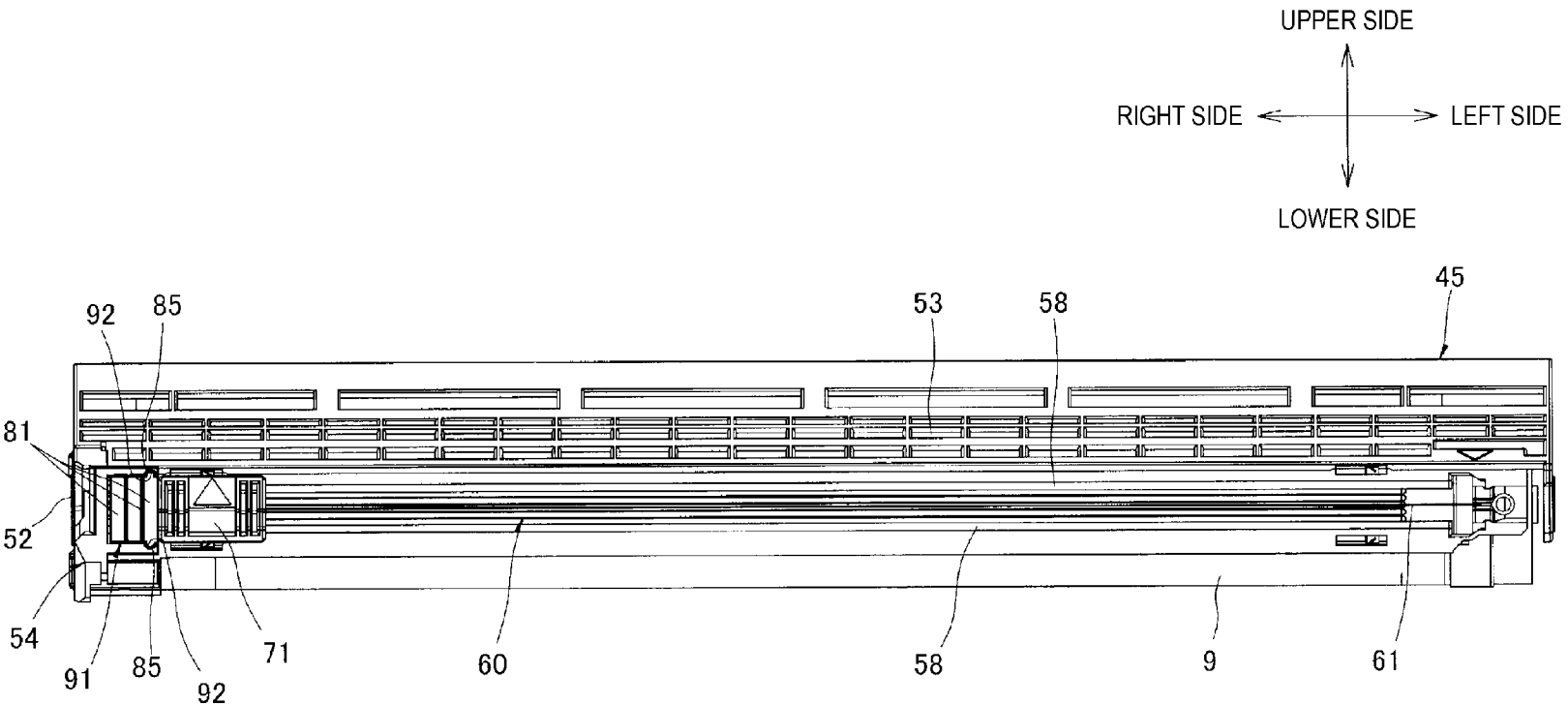
FIG. 9B is a rear view of the photosensitive drum and the upper wall, which shows the cleaner that has completely moved in the right direction.

When the cleaner 71 is moved to a position adjacent to the left side of the aside part 91, the three reinforcement members 81 are arranged at the aside part 91, and two engaging protrusions 85 (one example of an engaging part) of the leftmost reinforcement member 81 are engaged with the engaging recesses 92 (one example of an engaged part), as shown in FIGS. 9A and 9B. Here, the center and rightmost reinforcement members 81 have passed the engaging recesses 92.

Then, the cleaner 71 is moved leftwards. Since the engaging protrusions 85 are engaged with the engaging recesses 92, the three reinforcement members 81 stay at the aside part 91 even when the cleaner 71 is moved leftwards. Then, when the cleaner 71 is returned to the home position as shown in FIG. 5, the cleaning of the electric discharge wire 61 by the cleaner 71 is completed.

Incidentally, the reinforcement members 81 are removably mounted to the drum frame 8. Therefore, by pulling out the reinforcement member 81 in the rear-upper direction, an engaged state of the contact parts 83 and the leading end portions of both end portions of the operation part 82 in the longitudinal direction with the inner support parts 56 is released, so that the reinforcement member 81 can be separated from the drum frame 8.

3. Operational Effects (1) As described above, the photosensitive drum 9 is mounted such that the surface thereof can be moved in the first direction. The electric discharge wire 61 extends in the second direction (i.e., left-right direction) that is orthogonal to the first direction and parallel with the surface of the photosensitive drum 9 at an interval with the surface of the photosensitive drum 9. The photosensitive drum 9 and the electric discharge wire 61 are held by the drum frame 8.

The opening 60 is formed in the drum frame 8 at the opposite side of the photosensitive drum 9 across the electric discharge wire 61. Thereby, it is possible to introduce the air flow into the drum frame 8 from the outside of the drum frame 8 through the opening 60. By the air flow, it is possible to prevent the dusts and the like from being attached to the electric discharge wire 61 and to remove the dusts and the like attached to the electric discharge wire 61. As a result, it is possible to generate the uniform electric discharge from the electric discharge wire 61 in the second direction.

Also, the cleaner 71 is mounted to be movable along the opening 60. When the cleaner 71 is moved along the opening 60, the electric discharge wire 61 is cleaned by the cleaner 71, so that the dusts and the like attached to the electric discharge wire 61 are removed. Accordingly, the electric discharge wire 61 is cleaned, so that it is possible to generate the more uniform electric discharge from the electric discharge wire 61.

The reinforcement members 81, which are separate members from the cleaner 71, contact the drum frame 8. Since the surrounding part of the opening 60 is reinforced by the reinforcement members 81, it is possible to prevent the surrounding part of the opening 60 of the drum frame 8 from being deformed. Accordingly, it is possible to prevent the deformation of the grid electrode 63 and further to prevent the contact of the grid electrode 63 and the photosensitive drum 9.

(2) The reinforcement members 81 can be removed from the drum frame 8. Accordingly, it is possible to prevent the reinforcement members 81 from interfering with the moving of the cleaner 71.

(3) The reinforcement member 81 is formed with the beam part 84. The beam part 84 is provided between the pair of contact parts 83, so that it extends in the facing direction intersecting with the second direction. Thereby, the reinforcement member 81 has the large strength in the facing direction. Accordingly, it is possible to favorably prevent the surrounding part of the opening 60 of the drum frame 8 from being deformed in the facing direction.

(4) The surface 84A of the reinforcement member 81 opposed to the electric discharge wire 61 is recessed in a direction going away from the electric discharge wire 61. Thereby, it is possible to prevent the reinforcement member 81 from contacting the electric discharge wire 61.

(5) After the cleaner 71 contacts the left end surface 81A of the leftmost reinforcement member 81, the cleaner 71 is further moved, so that the pressing force is applied from the cleaner 71 to the left end surface 81A of the reinforcement member 81 and the reinforcement member 81 is thus moved together with the cleaner 71. Therefore, the moving of the cleaner 71 is not interrupted by the reinforcement member 81, so that it is possible to smoothly clean the electric discharge wire 61 by the cleaner 71.

(6) The drum frame 8 includes the aside part 91 at the left end portion of the opening 60. The reinforcement members 81 are arranged at the aside part 91, so that it is possible to put the reinforcement members 81 aside from the moving path of the cleaner 71. Thereby, it is possible to securely prevent the reinforcement members 81 from interfering with the moving of the cleaner 71.

(7) The reinforcement member 81 includes the engaging protrusions 85. The aside part 91 includes the engaging recesses 92 that are engaged with the engaging protrusions 85. Accordingly, when the reinforcement member 81 is arranged at the aside part 91, the engaging protrusions 85 of the reinforcement member 81 are engaged with the engaging recesses 92 of the aside part 91. As a result, when the reinforcement member 81 is once arranged at the aside part 91, the reinforcement member 81 continues to stay at the aside part 91, regardless of the moving of the cleaner 71. Therefore, it is possible to prevent the reinforcement member 81 from interrupting the moving of the cleaner 71. Also, when it is checked that the reinforcement member 81 is arranged at the aside part 91, it is possible to determine whether the electric discharge wire 61 has been cleaned in the past. To the contrary, when the reinforcement member 81 is not arranged at the aside part 91, it is possible to determine that the cleaning of the electric discharge wire 61 has not been finished.

4. Modifications to the Exemplary Embodiments

Exemplary embodiments of the present invention have been described above; however, these exemplary embodiments are merely examples, and do not limit the scope of claims. The technologies described in the scope of claims include various changes and modifications of the exemplified embodiments. Modifications of the exemplary embodiments will be exemplified below.

For example, in the above-described exemplary embodiments, three reinforcement members 81 are provided. Alternatively, the number of the reinforcement members 81 may be one, two or four or more.

In the above-described exemplary embodiments, the surface 84A of the beam part 84 opposed to the electric discharge wire 61 has the semicircular arc surface recessed toward the operation part 82. Alternatively, the surface 84A may have a U section that is recessed into a quadrangle shape.

In the above-described exemplary embodiments, the drum cartridge 6 has been adopted as an example of the photosensitive cartridge. Alternatively, the photosensitive cartridge may integrally have a configuration corresponding to the drum cartridge 6 and the developing cartridge 7. Further, the photosensitive cartridge may integrally have a configuration corresponding to the drum cartridge 6 and the developing chamber 15 (including the developing roller 18 and the supply roller 19 arranged in the developing chamber 15) of the developing cartridge 7 and the toner cartridge accommodating the toner may be removably mounted thereto.

In the above-described exemplary embodiments, a black-and-white laser printer has been adopted as an example of the image forming apparatus having the photosensitive cartridge. Alternatively, the photosensitive cartridge of the invention may be also provided to a color printer.

What is claimed is:

1. A photosensitive cartridge comprising:

a photosensitive member mounted to the photosensitive cartridge such that a surface of the photosensitive member is movable in a first direction;

an electric discharge electrode that extends in a second direction at an interval with the surface of the photosensitive member, wherein the second direction is orthogonal to the first direction and is parallel with the surface of the photosensitive member;

a frame, which holds the photosensitive member and the electric discharge electrode, and which comprises an opening at an opposite side of the photosensitive member across the electric discharge electrode, wherein the opening extends in the second direction;

a cleaner configured to be movable along the opening so as to clean the electric discharge electrode; and a reinforcement member, which is a separate member from the cleaner, and which is configured to contact the frame to reinforce a surrounding part of the opening, wherein the reinforcement member is configured to be removably mounted to an edge of the opening.

2. The photosensitive cartridge according to claim 1, wherein the reinforcement member comprises a beam part extending in a direction intersecting with the second direction.

3. A photosensitive cartridge comprising:

a photosensitive member mounted to the photosensitive cartridge such that a surface of the photosensitive member is movable in a first direction;

an electric discharge electrode that extends in a second direction at an interval with the surface of the photosensitive member, wherein the second direction is orthogonal to the first direction and is parallel with the surface of the photosensitive member;

a frame, which holds the photosensitive member and the electric discharge electrode, and which comprises an opening at an opposite side of the photosensitive member across the electric discharge electrode, wherein the opening extends in the second direction;

a cleaner configured to be movable along the opening so as to clean the electric discharge electrode; and a reinforcement member, which is a separate member from the cleaner, and which is configured to contact the frame to reinforce a surrounding part of the opening, wherein a surface of the reinforcement member facing the electric discharge electrode is recessed in a direction going away from the electric discharge electrode and separated from the electric discharge electrode.

4. A photosensitive cartridge comprising:

a photosensitive member mounted to the photosensitive cartridge such that a surface of the photosensitive member is movable in a first direction;

an electric discharge electrode that extends in a second direction at an interval with the surface of the photosensitive member, wherein the second direction is orthogonal to the first direction and is parallel with the surface of the photosensitive member;

a frame, which holds the photosensitive member and the electric discharge electrode, and which comprises an opening at an opposite side of the photosensitive member across the electric discharge electrode, wherein the opening extends in the second direction;

a cleaner configured to be movable along the opening so as to clean the electric discharge electrode; and a reinforcement member, which is a separate member from the cleaner, and which is configured to contact the frame to reinforce a surrounding part of the opening, wherein the reinforcement member comprises a contact surface, and wherein the cleaner is configured to move along the opening so as to contact the contact surface.

5. A photosensitive cartridge comprising:

a photosensitive member mounted to the photosensitive cartridge such that a surface of the photosensitive member is movable in a first direction;

an electric discharge electrode that extends in a second direction at an interval with the surface of the photosensitive member, wherein the second direction is orthogonal to the first direction and is parallel with the surface of the photosensitive member;

a frame, which holds the photosensitive member and the electric discharge electrode, and which comprises an opening at an opposite side of the photosensitive member across the electric discharge electrode, wherein the opening extends in the second direction;

a cleaner configured to be movable along the opening so as to clean the electric discharge electrode; and a reinforcement member, which is a separate member from the cleaner, and which is configured to contact the frame to reinforce a surrounding part of the opening, wherein the frame comprises an aside part, which is arranged on one side of the opening in the second direction, and which is configured to put the reinforcement member aside from a moving path of the cleaner.

6. The photosensitive cartridge according to claim 5, wherein the reinforcement member comprises an engaging part, and wherein the aside part comprises an engaged part that is configured to engage with the engaging part.

7. A photosensitive cartridge comprising:

a photosensitive member mounted to the photosensitive cartridge such that a surface of the photosensitive member is movable in a first direction;

an electric discharge electrode that extends in a second direction at an interval with the surface of the photosensitive member, wherein the second direction is orthogonal to the first direction and is parallel with the surface of the photosensitive member;

a frame, which holds the photosensitive member and the electric discharge electrode, and which comprises an opening at an opposite side of the photosensitive member across the electric discharge electrode, wherein the opening extends in the second direction;

a cleaner configured to be movable along the opening so as to clean the electric discharge electrode; and a plurality of reinforcement members, each of the reinforcement members being a separate member from the cleaner and configured to contact the frame to reinforce a surrounding art of the opening, wherein the opening has a rectangular shape extending in the second direction, and wherein the reinforcement members are removably mounted to the frame along the second direction.

8. The photosensitive cartridge according to claim 7, wherein the frame comprises an aside part, which is arranged on one side of the opening in the second direction, and which is configured to put the plurality of the reinforcement members aside from a moving path of the cleaner, wherein the plurality of the reinforcement members comprises:

a first reinforcement member closest to the cleaner among the plurality of the reinforcement members in the second direction; and a second reinforcement member, wherein the aside part comprises an engaged part, wherein the first reinforcement member comprises an engaging part that is configured to engage with the engaged part, and wherein the second reinforcement member is configured to pass the engaged part.

* * * * *

UNITED STATES PATENT AND TRADEMARK OFFICE

CERTIFICATE OF CORRECTION

PATENT NO. : 8,843,027 B2
APPLICATION NO. : 13/361593
DATED : September 23, 2014
INVENTOR(S) : Hiroki Mori et al.

It is certified that error appears in the above-identified patent and that said Letters Patent is hereby corrected as shown below:

Title page, item (56) Other Publications:
Please delete "JP Office Action mail" and insert --JP Office Action mailed--

Claims
In Column 13, Claim 7, Line 8:
Please delete "surrounding art" and insert --surrounding part--

Signed and Sealed this
Sixteenth Day of August, 2016

Michelle K. Lee

Michelle K. Lee
*Director of the United States Patent and Trademark Office*